US005272280A

United States Patent [19]

Cosley et al.

[11] Patent Number: 5,272,280

[45] Date of Patent: Dec. 21, 1993

[54] OVERVOLTAGE PROTECTOR ASSEMBLY

[75] Inventors: Michael R. Cosley, Crystal Lake; Casimir Z. Cwirzen, Arlington Heights, both of Ill.

[73] Assignee: Northern Telecom Limited, Montreal, Canada

[21] Appl. No.: 714,720

[22] Filed: Jun. 13, 1991

[51] Int. Cl.[5] ..... H01R 9/16

[52] U.S. Cl. ..... 174/65 R; 174/153 R; 361/119

[58] Field of Search ..... 174/65 R, 151, 152 E, 174/153 R; 361/119, 120

[56] References Cited

U.S. PATENT DOCUMENTS

| | | | |
|---|---|---|---|
| 3,828,290 | 8/1974 | Kawiecki | 337/186 |
| 4,047,790 | 9/1977 | Carino | 339/220 C |
| 4,447,848 | 5/1984 | Smith | 361/124 |
| 4,675,778 | 6/1987 | Cwirzen | 361/119 |

*Primary Examiner*—Leo P. Picard
*Assistant Examiner*—David Tone
*Attorney, Agent, or Firm*—Foley & Lardner

[57] ABSTRACT

An overvoltage protector assembly and a method of attaching a terminal member through a dielectric body. The assembly has a dielectric body, and line terminal members extending through the body into a chamber within. The terminal members each have a shaft passing through the body and first and second radially extending, opposing abutment surfaces which engage inner and outer surfaces of the body. The body is compressed between the opposing abutment surfaces in an axial direction of the shaft to deform the body inwards to sealingly engage the terminal member between the opposing abutment surfaces. The body is formed with axial projections around apertures receiving the line terminals, so that compressing the body results in displacement of material of the body to form annular projections sealingly engaging around the shaft between the abutment surfaces. Peripheral surfaces of the terminal member are cooperable with the body to prevent relative rotation of the body and the terminal member. The line terminal members are connected to a grounding terminal within the chamber via an overvoltage protection device.

14 Claims, 5 Drawing Sheets

OVERVOLTAGE PROTECTOR ASSEMBLY

The present invention relates to overvoltage protector assemblies and a method of attaching a terminal means through a dielectric body of an overvoltage protector assembly.

Conventional overvoltage protector assemblies of the type used with telecommunications lines comprise an electrically insulating dielectric body carrying line contact terminal members each connected via an overvoltage protection device, such as a gas tube or spaced carbon electrodes, to a grounding terminal member. In use of a protector assembly, a pair of communications lines are connected to the line terminal members and the grounding terminal member is grounded so that application of an overvoltage to a line terminal member, for example, as caused by lightning, power contacts, surges on the lines, results in operation of the overvoltage protection device to create a conductive path between the line terminal member and the grounding terminal member for leading the overvoltage to ground and thus reducing the likelihood of damage to line equipment or personnel. An example of a known overvoltage protector assembly for exterior use with communications lines comprises a dielectric body, a pair of line terminal members and a grounding terminal member passing through the body, each line terminal member being connected, within a chamber of the body, to the grounding terminal member via an overvoltage protection device comprising a gas tube. Each line terminal member has first and second opposite end portions. The first end portion is knurled and an end of the first end portion provides an abutment surface extending radially outwards from the first end portion which engages the body around an aperture through which the terminal member passes out of the chamber; the second end portion, accessible from outside the body, is threaded for receiving one or more nut members for securing line conductors to the terminal member. The dielectric body comprises a thermoplastic material which is heat staked or ultrasonically staked around the knurled portion of the terminal member to form a seal around the terminal member and hold the terminal member immovably in the body. However in use of these overvoltage protector assemblies, leakage of moisture into the body around the terminal members where the members pass into the chamber leads to problems in use of the protector assemblies.

The present invention seeks to provide an overvoltage protector assembly which avoids or reduces the above mentioned problems.

Thus according to one aspect of the present invention there is provided an overvoltage protector assembly comprising: a dielectric body having an outer surface and an inner surface, the inner surface defining a chamber within the body; at least one line terminal means passing through the body and into the chamber; the line terminal means having a shaft extending axially through the body, and first and second radially extending, opposing abutment surfaces engaging inner and outer surfaces of the body around the terminal means, the body being compressed between said opposing abutment surfaces in an axial direction of the shaft, the body thereby sealingly engaging around the terminal means between the first and second abutment surfaces, and the terminal means and the body having cooperable rotation prevention means to prevent rotation of the terminal means relative to the body.

Thus the body is compressed between opposing abutment surfaces of the terminal means to sealingly engage around the terminal member.

In an advantageous structure, the terminal means comprises a terminal member and a washer member. The terminal member is provided with the shaft having one end and an enlarged portion spaced axially from the one end. The enlarged portion of the shaft provides the first abutment surface, and the shaft is received through the body with the first abutment surface engaging the outer surface of the body, the washer member is received around the shaft within the chamber and provides the second abutment surface. The body is compressed around the terminal member, in an axial direction of the terminal member, between the enlarged portion and the washer member with a part of the shaft extending beyond the washer member, and said part is deformed so as to retain the washer member on the one end of shaft and thereby hold the terminal member immovably through the body. The enlarged portion has flat peripheral surfaces cooperable with opposing surfaces of the body to prevent rotation of the terminal member.

According to another aspect of the present invention there is provided a method of attaching a terminal member through a dielectric body, the method comprising: providing a dielectric body having inner and outer surfaces, the inner surface defining a chamber and the body having an aperture therethrough; slidably inserting a shaft of a terminal means into the aperture and contacting inner and outer oppositely facing surfaces of the body around the aperture with first and second opposing abutment surfaces of the terminal means; compressing the body around the terminal means between the opposing abutment surfaces of the terminal means and maintaining the body compressed between opposing first and second abutment surfaces of the terminal means so as to deform the body and sealingly engage against the terminal means between the first and second abutment surfaces.

Preferably each of the inner and outer surfaces of the body is formed with an axially extending projection surrounding the aperture and each projection is engaged by a corresponding abutment surface, and the step of compressing the body between the washer member and the enlarged portion comprises axially compressing and deforming said projections to provide radially inwardly extending annular projections sealingly engaging around the shaft adjacent and lying between first and second abutment surfaces.

The step of compressing the body between first and second abutment surfaces causes cold flow of the axially extending projections into the body to displace material of the body to provide the radially inwardly extending annular projections.

According to a further aspect of the present invention there is provided a body and terminal means combination of an overvoltage protector assembly comprising: a dielectric body having an outer surface and inner surface, the inner surface defining a chamber within the body, and an aperture extending through the body, a line terminal means having a shaft slidably receivable through the aperture, and first and second abutment surfaces for engagement with the inner and outer surfaces of the body around said aperture, the inner and outer surfaces of the body each formed with an axially extending projection surrounding the aperture for engaging the corresponding first and second abutment surfaces, the body being compressible between the first and second abutment surfaces to deform the body and to provide radially inwardly extending annular projections sealingly engaging around the shaft adjacent and lying between first and second abutment surfaces, and, the terminal means and the body having co-operable means for prevention of relative rotation of the terminal means within the body.

Thus the present invention provides an overvoltage protector assembly, a body and terminal means combination of an overvoltage protector assembly, and a method of attaching a terminal means through a dielectric body of an overvoltage protector assembly, which in use reduce the above mentioned problems of sealing and moisture infiltration.

One embodiment of the invention will now be described by way of example, with reference to the accompanying drawings, in which.

Figure 7A:
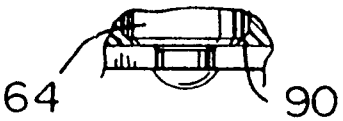
FIG. 7 is a cross sectional view along line VII—VII in FIG. 6.
Figure 7:
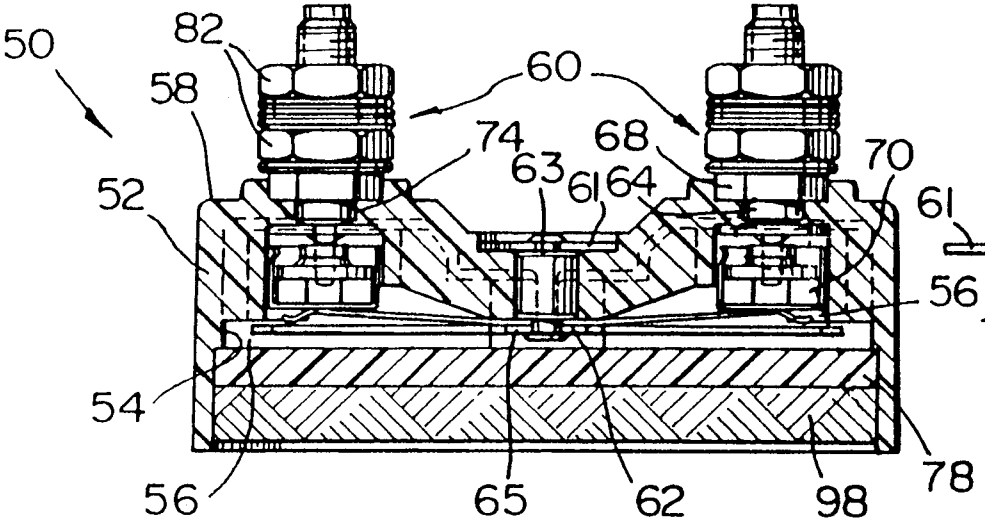

FIG. 7*a* is an enlarged view of a detail in FIG. 7.

Figure 8:
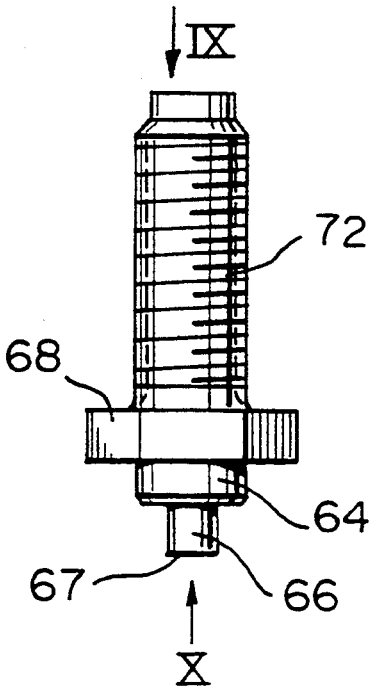

FIG. 8 is an enlarged view of a terminal member of the assembly the first embodiment.

Figure 9:
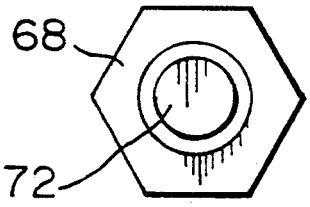
Figure 10:
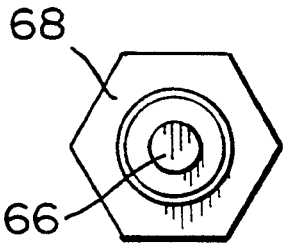

FIGS. 9 and 10 are views, respectively, along arrows IX and X in FIG. 8.

Figure 11:
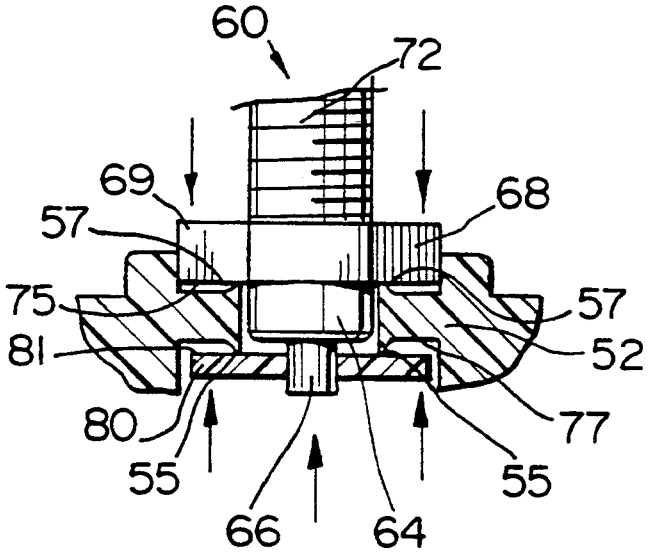
Figure 12:
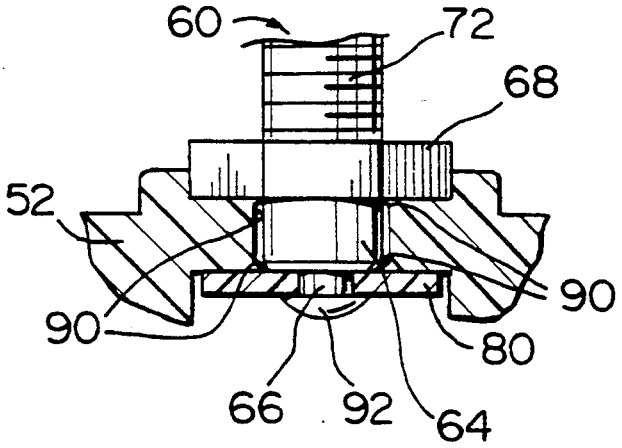

FIGS. 11 and 12 are a schematic enlarged cross-sectional views of part of the assembly of the embodiment at progressive stages of a method of providing a terminal member through a body.

Figure 5:
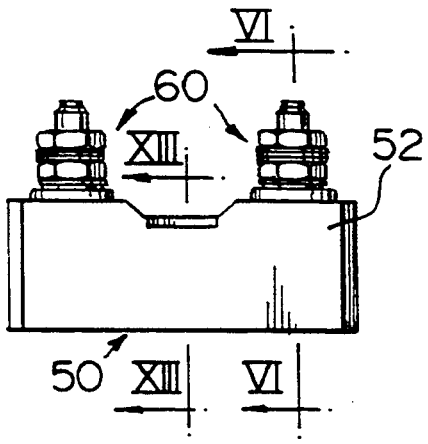
FIG. 5 is a view, on a different scale of the assembled the overvoltage protector assembly of the embodiment in the direction along arrow V of FIG. 4.
Figure 6:
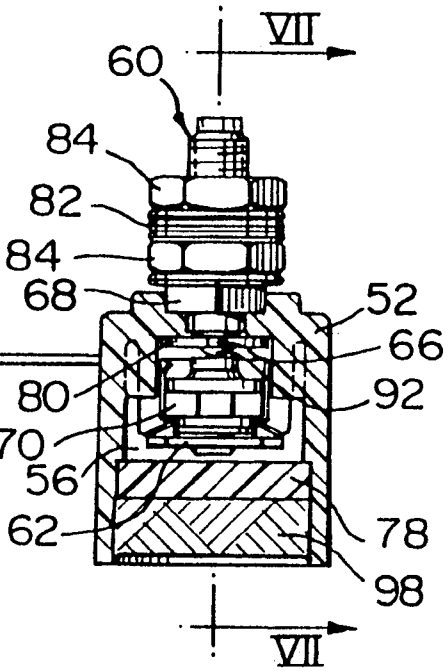
FIG. 6 is an enlarged cross-sectional view along line VI—VI in FIG. 5.
Figure 13:
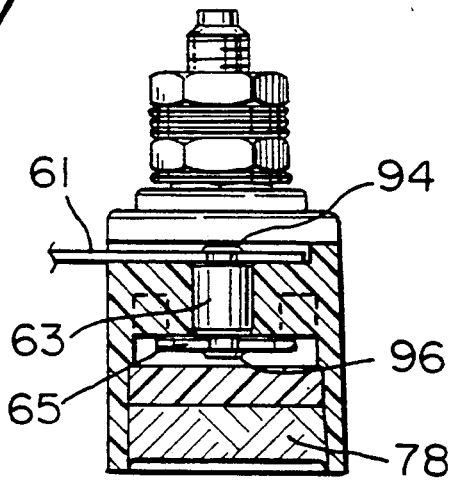

FIG. 13 is an enlarged cross-sectional view along line XIII—XIII in FIG. 5.

Figure 1:
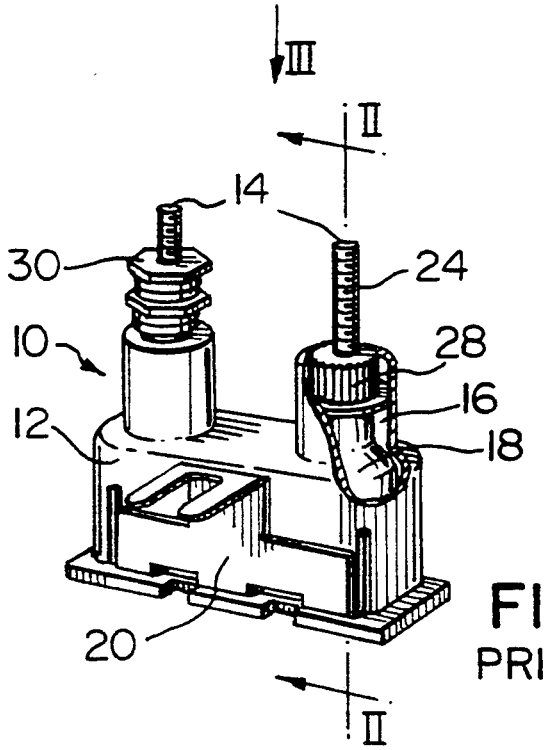
FIG. 1 PRIOR ART
FIG. 1 is a partially cut away view of an overvoltage protector assembly of known prior art structure.
Figure 2:
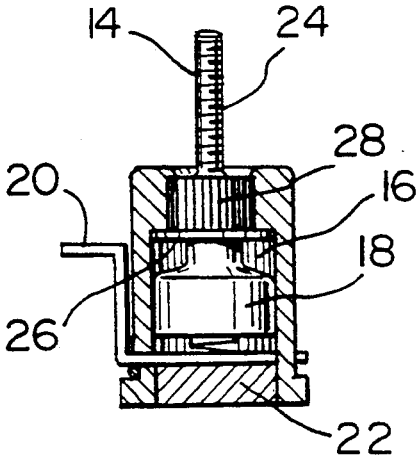
FIG. 2 PRIOR ART
FIG. 2 is enlarged cross sectional view taken along the line II—II in FIG. 1.
Figure 3:
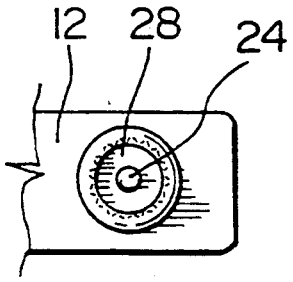
FIG. 3 PRIOR ART
FIG. 3 is a view in the direction of arrow III of part of the prior art assembly of FIG. 1.
Figure 4:
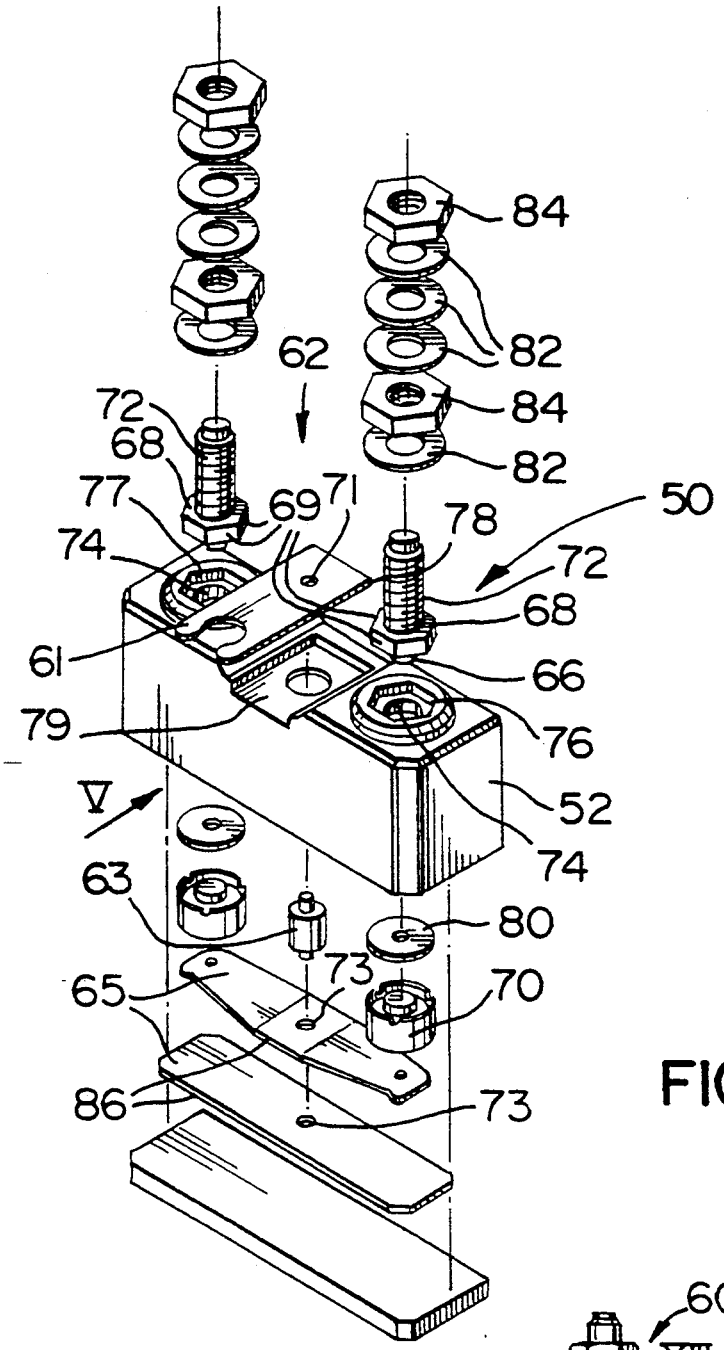
FIG. 4 is an isometric exploded view of an overvoltage protector assembly according to an embodiment of the invention.

A prior art overvoltage protector assembly 10 of the type used with telecommunications lines is shown in FIGS. 1 to 3. The overvoltage protector assembly 10 comprises a dielectric body 12, defining therein a chamber 16, and a pair of line terminal members 14 passing through the body into the chamber 16. Each line terminal member 14 is connected within the chamber via an overvoltage protection device, i.e. a gas tube 18, to a grounding terminal member 20 (FIG. 2) passing into the chamber near the base 22 of the body. Each line terminal member 14 comprises a threaded shaft portion 24 having at one end 26 a knurled enlarged part 28. The terminal member is retained within the body 12 by heat staking or ultrasonic staking of the body around the knurled enlarged part 28 (FIG. 3). A series of threaded nuts 30 is shown around the threaded shaft portion 24 of the terminal member 14 for attaching conductors to the shaft 24, but alternative conventional means for attaching conductors to terminal members may be used.

The heat staked portion of the body engaging around knurled part 28 holds the terminal member 14 securely to prevent rotation. However in use, sealing between the knurled portion and the body is not absolute and the grooves of the knurled portion are found to provide passage for moisture between the body and the knurled portion.

An overvoltage protector assembly 50 according to an embodiment of one aspect of the present invention is shown in FIGS. 4 to 12. The assembly 50 comprises a dielectric body 52 having an inner surface 54 defining a chamber 56 within the body and an outer surface 58. The body is formed from a rigid but cold deformable dielectric plastic material, for instance, 15% glass filled polyester. A pair of line terminal members 60 pass through the body 52 into the chamber 58. Each line terminal member 60 forms part of a line terminal means and is connected within the chamber 58 via an overvoltage protector device 70, which comprises a gas tube, to a grounding terminal means 62.

Each line terminal member 60 comprises a shaft 64 (FIG. 8) having at one end a narrow axially extending portion 66 terminating at one end 67, and an integral enlarged portion 68 at the other end of the shaft. A threaded extension 72 of the shaft is provided to receive washers 82 and nuts 84 which provide means for securing a conductor to the terminal member 60 (FIGS. 4 to 7). The enlarged portion 68 has flat peripheral surfaces 69 and has the outside form of a hexagonal nut member. The hexagonal enlarged portion 68 is received within a correspondingly shaped recess 76 defined by the outer surface 58 of the body 52 around an aperture 74 through the body, through which the shaft 64 extends with the narrow axially extending portion 66 received into the chamber 58. The peripheral surfaces 69 of the enlarged portion 68 are co-operable with opposing surfaces of the body 52 within the recess 76 to prevent relative rotation of the terminal member 60 and the body 52. One side of the enlarged portion 68 provides a first abutment surface 75, facing axially and engaging the outer surface 58 of the body within recess 76. The line terminal means also comprises a washer member 80 received over the narrow end portion 66 of terminal member 60. The body 52 is compressed between the washer member 80 and the enlarged portion 68, with a second abutment surface 81 provided by the washer member 80 opposing the first abutment surface 75 of the enlarged portion 68, thereby securing the terminal member 60 through the body (FIG. 7). The end of the narrow end portion 66 is deformed outwards to provide a retaining head 92 so as to retain the washer member 80 on the end portion 66 with the body 52 compressed between the opposing first and second abutment surfaces, 75 and 81, thereby holding the terminal member 60 immovably through the body.

A fluid tight seal is provided at the two ends of the shaft 64 by two radially inwardly extending projections 90 which sealingly engage around the shaft 64 adjacent the enlarged portion 68 and the washer member 80 (FIG. 12).

Each terminal means is attached to the body in the following manner.

The body 52 is moulded with annular axially extending projections or ribs 55 and 57 on the inner and outer surfaces 54 and 58 respectively immediately around each aperture 74 (FIG. 11). The shaft 64 of the terminal member 60 is slidably inserted into its corresponding aperture 74 and rotated until the hexagonal enlarged portion 68 engages in the complementary recess 76 in the outer surface 58, and the first abutment surface 75 of the enlarged portion 68 engages the outer surface 58 of the body within the recess 76. The washer member 80 is applied around the narrow portion 66 of the shaft 64 of the terminal member 60 extending within the chamber 56 (FIG. 11). The body 52 is then compressed between the washer member 80 and the enlarged portion 68, in an axial direction of the shaft 64, i.e. in the direction shown by arrows in FIG. 11. The end of the terminal member extending beyond washer 80 is then deformed by axial pressure to provide the retaining head 92 to secure the washer 80 on the narrow portion 66 and thereby hold the terminal member 60 immovably through the body 52 (FIG. 12).

During compression, there is a cold flow displacement of the material of the body causing the material of the annular axially extending projections 55 and 57 (FIG. 11) to merge into the body, thereby eliminating these ribs and displacing material of the body and forming the radially inwardly extending annular projections 90 which flow into sealing engagement with the shaft 64. The projections 90 sealingly engage around at least parts of the shaft 64 adjacent and lying between first 75 and second 81 abutment surfaces (FIG. 12).

Thus, where the body 52 comprises a suitable rigid and cold flowable dielectric material such as 15% glass filled polyester, the step of compressing the body between first and second abutment surfaces may cause cold working or cold flow of the material of the body 52 in the required manner to provide the sealing action.

The ribs 55 and 57 are of such minute size that relatively little force is required to displace the small amount of material forming the ribs and cold working is accomplished without shattering or otherwise distorting the body. The ribs may have a height of about 0.010 inches and a base width of about 0.013 inches. Further, the method according to the embodiment provides that the aperture 74 may be of sufficiently large diameter relative to the narrow portion 66 of the terminal member, i.e. a clearance of 0.006" to 0.015", that there is substantially no resistance to insertion of the terminal member 60 into the aperture 74, and yet the method provides a good seal between the terminal member 60 and the body 52.

The grounding terminal means 62 is sealingly and immovably secured through the body 52 in a similar manner as for the line terminal means (FIG. 13). The grounding terminal means 62 comprises a terminal shaft 63 having, at opposite ends, narrow axially extending end portions 94 and 96 and terminal portions in the form of elongate terminal plate members 61 and 63 having apertures 71 and 73 therethrough which are received around end portions 94 and 96. The body 52 is compressed between opposing surfaces of terminal plate members 61 and 65 to form a seal around the shaft 63 in a similar manner as described above for the line terminals members, and the ends of the shaft are deformed to secure the plate members 61 and 65. Plate member 61 is received in complementary shaped recess 79 of the body 52 and sides 78 of the plate member 61 engage outer surface 58 of the body 52 to prevent rotation of the plate member relative to the body. Plate member 65 comprises two parts which are received within the chamber 58 of the body 52, sides 86 of the plate member 65 engaging the body inside the chamber to prevent rotation of the plate member 65 within the chamber. The chamber is sealed around the junction of the body 52 and the base 78 by a layer of suitable sealing material, i.e. potting compound 98.

Thus the method as described above provides for attaching a terminal member to a dielectric body which minimizes the amount of material to be deformed and therefore the amount of pressure required to form a compressive seal of the body around the terminal member.

What is claimed is:

1. An overvoltage protector assembly comprising;

a dielectric body having an outer surface and an inner surface, the inner surface defining a chamber within the body;

at least one line terminal means having a shaft extending axially through an aperture and into the chamber, and first and second radially extending, opposing abutment surfaces engaging inner and outer surfaces of the body around the shaft to compress the body between the abutment surfaces;

the body also having an integral annular radially inwardly extending projection at one end of the aperture, the projection having been deformed from the body radially inwards into annular sealing contact with a portion of the shaft; and the terminal means and the body having cooperable rotation prevention means to prevent rotation of the terminal means relative to the body.

2. An assembly according to claim 1 wherein the line terminal means comprises a terminal member provided with the shaft having one end and an enlarged portion spaced axially along the shaft from the one end, the enlarged portion providing the first abutment surface, and the enlarged portion and the body together providing the rotation prevention means, the shaft received through the body with said first abutment surface engaging the outer surface of the body, and the terminal means also comprising a washer member received around the shaft within the chamber and providing said second abutment surface, the body being compressed around the terminal member, in an axial direction of the terminal member, between the enlarged portion and the washer member with a part of the shaft extending beyond the washer member and said part being deformed so as to retain the washer member on the shaft and thereby hold the terminal member immovably through the body.

3. An assembly according to claim 2 wherein the enlarged portion has flat peripheral surfaces cooperable with opposing surfaces of the body to prevent rotation of the terminal member.

4. An assembly according to claim 1 wherein the terminal means comprises a terminal member provided with the shaft with first and second end portions, the shaft received through the body with first and second end portions extending from the body, the terminal means also comprising two plate members, received one around each end portion of the shaft and providing the first and second opposing radially extending abutment surfaces, the plate members cooperable with the body to provide rotation prevention means and the body being compressed around the shaft in an axial direction of the shaft, between opposing surfaces of the plate members with a part of the end portion of the shaft extending beyond the corresponding plate member and said part being deformed so as to retain the plate member on the shaft and thereby hold the terminal member immovably through the body.

5. An assembly according to claim 4 wherein the plate member has flat peripheral surfaces cooperable with opposing surfaces of the body to prevent rotation of the terminal member.

6. An assembly according to claim 1 wherein the body comprises 15% glass filled polyester.

7. A method of attaching a terminal means through a dielectric body, the method comprising:

providing a dielectric body having inner and outer surfaces, the inner surface defining a chamber and the body having an aperture therethrough;

inserting a shaft of a terminal means though the aperture and contacting regions of the inner and outer surfaces of the body around the aperture with first and second opposing abutment surfaces of the terminal means, the body having an integral axially extending compressible projection means on one of its inner and outer surfaces immediately around one end of the aperture;

non-rotatably securing the terminal mans to the body while compressing the body in an axial direction of the shaft between said first and second abutment surfaces while simultaneously compressing the projection means axially and causing the formation of a radially inwardly extending annular projection into annular sealing engagement with the shaft at said one end of the aperture; and maintaining the body compressed between the first and second abutment surfaces of the terminal means so as to maintain the seal.

8. A method according to claim 7 wherein the terminal means comprises a shaft having an integral enlarged portion spaced axially along the shaft from an end of the shaft, the enlarged portion providing a first abutment surface facing the one end, and comprising slidably inserting the one end through the aperture until the first abutment surface engages the outer surface of the body and the one end extends into the chamber, applying a washer member around the shaft at the one end after inserting said one end through the body, until a second opposing abutment surface opposing the first abutment surface and provided by the washer member engages the inner surface of the body, compressing the body between the washer member and the enlarged portion, and deforming the shaft at said one end whereby the washer member is retained on the shaft and the body is compressed between the opposing first and second abutment surfaces so as to deform the body radially inwards around the shaft and so as to sealingly engage the shaft between the first and second abutment surfaces.

9. A method according to claim 8 wherein each of the inner and outer surfaces of the body is formed with an axially extending projection surrounding the aperture, the projections being engaged by the corresponding first and second abutment surfaces, and the step of compressing the body between the washer member and the enlarged portion comprises compressing and deforming said projections to provide radially inwardly extending annular projections sealingly engaging around the shaft adjacent and lying between first and second abutment surfaces.

10. A method according to claim 9 wherein the step of compressing the body between first and second abutment surfaces causes cold flow of the axially extending projections into the body to displace material of the body to provide the radially inwardly extending annular projections.

11. A method according to claim 7, wherein the integral axially extending compressible projection means comprises a moulded annular axially extending projection, the method comprising the step of compressing the body between said regions of its inner and outer surfaces around the aperture to effect a cold flow displacement of material of the body thus causing the material of the annular axially extending projection to merge into the body, thereby displacing the material of the body and forming the radially inwardly extending annular projection to flow into annular sealing engagement with the shaft at said one end of the aperture.

12. A body and terminal means combination of an overvoltage protector assembly comprising:

a dielectric body having an outer surface and inner surface, the inner surface defining a chamber within the body, and an aperture extending through the body, a line terminal means having a shaft slidably receivable through the aperture, and first and second abutment surfaces for engagement with the inner and outer surfaces of the body around said aperture, the inner and outer surfaces of the body each formed with an axially extending projection surrounding the aperture for engaging the corresponding first and second abutment surfaces, the body being compressible between the first and second abutment surfaces to deform the body and to provide radially inwardly extending annular projections sealingly engaging around the shaft adjacent and lying between first and second abutment surfaces, and, the terminal means and the body having cooperable means for prevention of relative rotation of the terminal means within the body.

13. A body and terminal means combination of an overvoltage protector assembly according to claim 12 wherein:

the terminal means comprises a terminal member provided with the shaft having one end and an enlarged portion spaced axially along the shaft from the one end, the shaft being slidably receivable through said aperture and the terminal means also comprising a washer member receivable over the one end, the enlarged portion of the terminal member and the washer member thereby providing opposing first and second abutment surfaces for engaging the outer and inner surfaces of the body, and the body larged portion to deform the body and to provide radially inwardly extending annular projections sealingly engaging around the shaft adjacent and lying between first and second abutment surfaces.

14. A body and terminal member combination of an overvoltage protection assembly according to claim 12 wherein the shaft has a first and a second end, one end being slidably receivable through said aperture, and two plate members, receivable one over each of the first and second ends of the shaft, and the plate members providing the first and second abutment surfaces whereby the body is compressible between the plate members to deform and sealingly engage the body against terminal means between the first and second abutment surfaces of the plate members.

* * * * *